United States Patent [19]

Stieber et al.

[11] 4,083,387

[45] Apr. 11, 1978

[54] MEANS CONTROLLING THE DELIVERY OF OIL TO A STORAGE TANK

[76] Inventors: Albert Stieber, 1449 Franklin Drive, Chomedey, Quebec; Werner Ferch, 305 Eugene Street, Fabreville, Quebec, both of Canada

[21] Appl. No.: 720,733

[22] Filed: Sep. 7, 1976

[30] Foreign Application Priority Data

Jul. 5, 1976 Canada ..... 256445

[51] Int. Cl.[2] ..... B65B 3/36

[52] U.S. Cl. ..... 141/95; 137/392; 137/558; 141/198

[58] Field of Search ..... 73/69, 552; 141/1, 94–96, 141/128, 198, 206, 217, 285, 301, 302, 392; 137/392, 558

[56] References Cited

U.S. PATENT DOCUMENTS

| | | | |
|---|---|---|---|
| 3,548,779 | 12/1970 | Green | 141/95 X |
| 3,662,792 | 5/1972 | Grant | 141/198 |
| 3,814,146 | 6/1974 | Mesh | 141/198 X |

*Primary Examiner*—Richard E. Aegerter
*Assistant Examiner*—Frederick R. Schmidt
*Attorney, Agent, or Firm*—Larson, Taylor and Hinds

[57] ABSTRACT

A system for controlling the filling of a storage tank with a fluid in which the storage tank normally is provided with a sound transmitting device activated when the fluid reaches the level of the sound transmitting device. The system includes a time delay for continued feeding of fluid to the storage tank, the time delay being controlled to permit the void in the storage tank above the level of the sound transmitting device to be filled with fluid to the maximum capacity of the tank.

4 Claims, 3 Drawing Figures

MEANS CONTROLLING THE DELIVERY OF OIL TO A STORAGE TANK

This invention relates to means for controlling the delivery of fluid, particularly oil to storage tanks.

Domestic fuel oil tanks are traditionally filled from a tank car by using a manually operated valve incorporated in the nozzle of the oil feed pipe. This nozzle is pushed into the fill pipe of the tank which is provided with a vent pipe located close to the fill pipe. Protruding into the storage tank from the vent pipe by about 5½ or 6 inches is a whistle device, with the whistle itself being located inside the vent pipe. When the tank is being filled, most of the trapped air escapes through the vent pipe and thereby activates this whistle. The high-pitch audible sound from the whistle is the signal which, when this signal stops, tells the operator to manually close the valve in the nozzle and thereby shut off the flow of liquid to the storage tank.

Such a system of control of the flow of liquid has the following disadvantages:

(1) If the operator is inattentive, an oil spill does occur, since the shutting of the valve is dependent on the operator's reaction time.

(2) The fuel tank is never filled to capacity due to the fact that the whistle device, located in the end of the vent pipe, is situated at a distance below the top of the tank and the operator shuts off the supply of fuel as soon as the rising fuel contacts the whistle and the whistle ceases to emit a sound. The larger the tank, the greater is the loss of fuel capacity at any one filling of the tank.

According to one aspect of the present invention, a fluid delivery apparatus includes a trigger shut-off valve on the delivery nozzle end of the fill pipe between a supply vehicle and an oil storage tank, the valve having an operating means for closing the shut off valve, a microphone which picks up the sound of a whistle in the vent of the storage tank, and through an amplifier produces a signal which prevents the operating means from closing the shut off valve. When the whistle ceases, the microphone identifies the change, and the amplifier shuts off the signal. A time delay means prevents the operating means from closing the valve for a predetermined time after the whistle stops.

Included as part of the apparatus is a dial marked to indicate various capacities of fuel tanks with a setting hand which is set by the operator to indicate the capacity of the tank to be filled. The setting of the hand on the dial controls the predetermined time the flow of fuel into the tank continues after the whistle ceases in order that the tank can be filled to its full capacity.

Figures 1, 2:
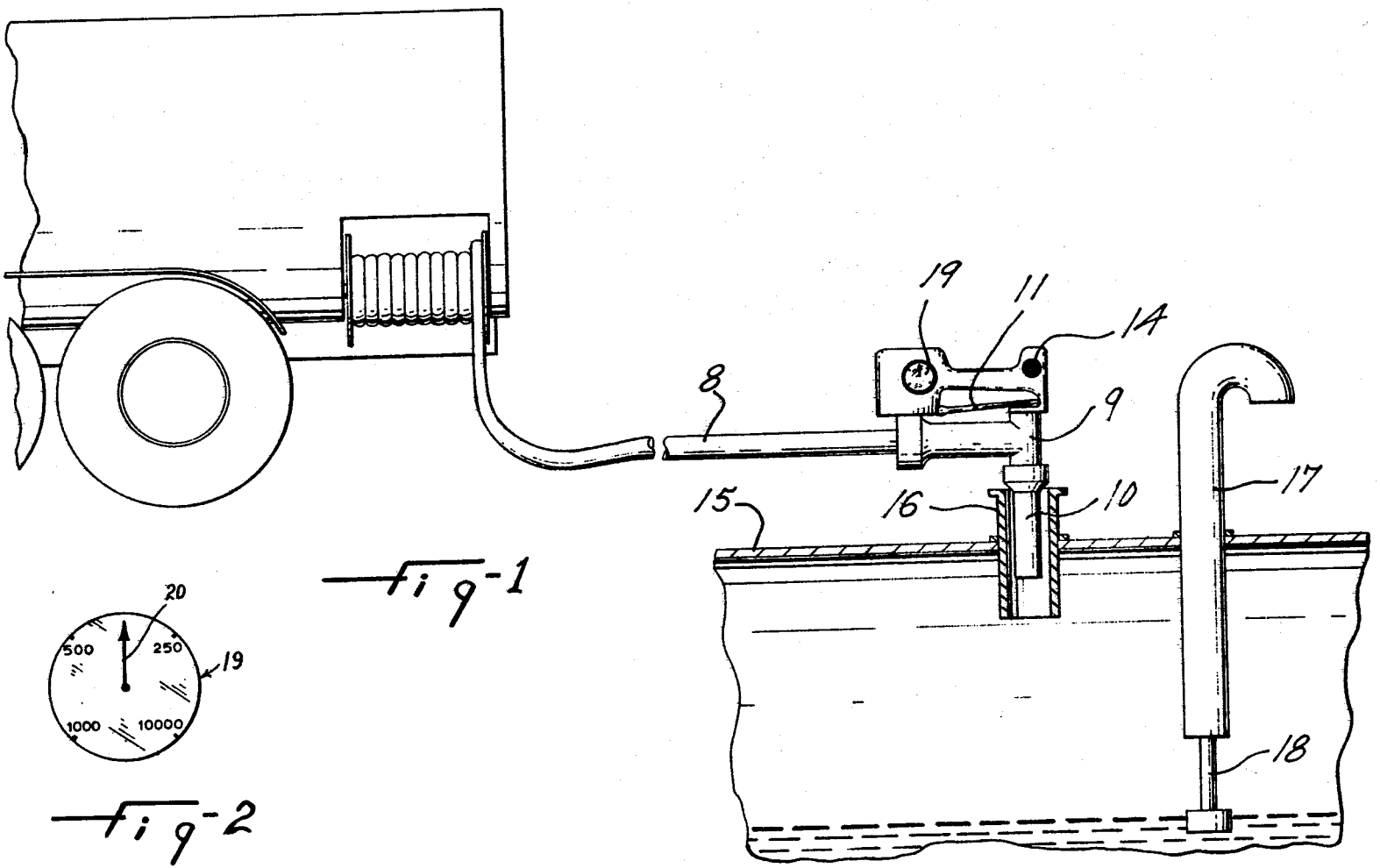
FIG. 1 is a diagrammatic view partly in section showing fluid delivery system according to the present invention.
FIG. 2 is a schematic showing of the tank capacity setting dial for controlling the time delay holding the fill valve in the open position.

Referring to the drawings FIG. 1 shows an oil delivery truck 5, an oil delivery hose 8, and an oil delivery apparatus 9, consisting of a spout 10, a trigger shut-off valve 11 and a microphone 14 which is shown integeral with the oil delivery apparatus 9. Included in the oil delivery apparatus 9 is a fluid tank capacity setting dial

19, shown in detail in FIG. 2 on which the hand 20 is set to the capacity of the fluid tank to be filled. An oil tank reservoir 15 includes a fill pipe 16, a vent pipe 17 and a whistle device 18 located in the end of the vent pipe 17 within the tank 15.

Figure 3:
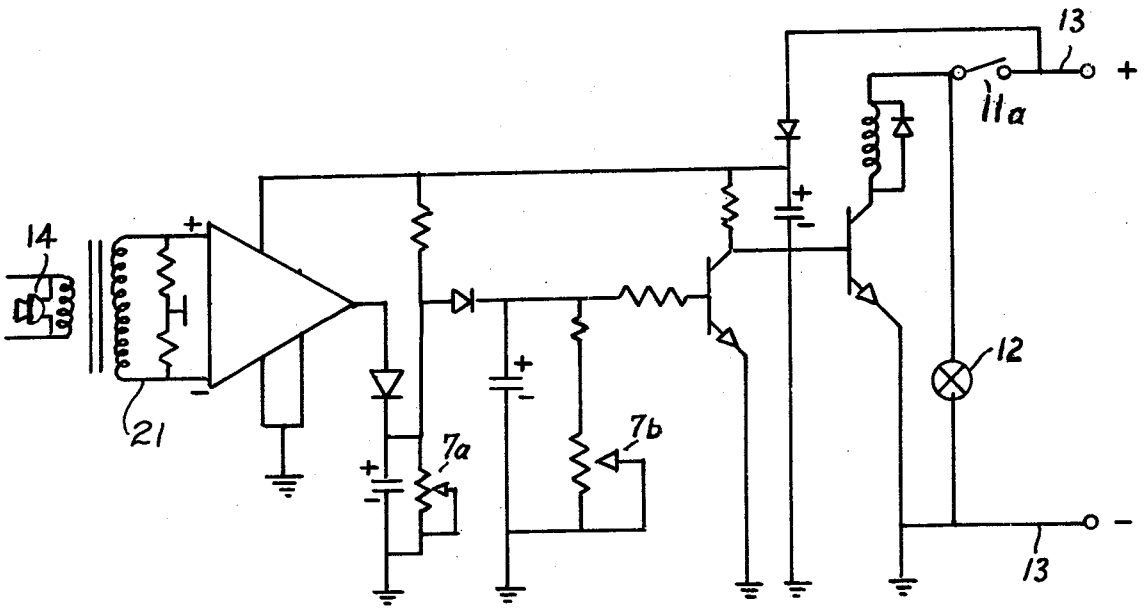
FIG. 3 is a typical schematic wiring diagram of the time delay circuits controlling the opening and closing of the fill valve.

Referring now to the schematic wiring diagram shown in FIG. 3, the oil delivery apparatus 9 comprises a power source 13 which may be a small battery forming part of the oil delivery apparatus or may come from the supply vehicle 5 by means of electrical wires passing through the oil delivery hose. The trigger shut off valve 11 shown in FIG. 1 also closes the switch 11*a* to allow power to the solenoid 12 which holds the trigger shut off valve open. The microphone 14 has an amplifier circuit 21, a first time delay circuit *7a* which delays commencing a signal from the amplifier circuit 21, and a second time delay circuit *7b* which delays shutting off the signal from the amplifier circuit 21. As soon as the signal from the amplifier is cut off, the solenoid 12 is activated to disengage the trigger shut off valve 11 and thus closes the valve.

The second time delay circuit *7b* is of the variable type and not fixed for the following reason: The whistle alarm 18, protruding into the oil tank 15 from the vent pipe 17, is of the same length (approximately 6 to 7 inches) regardless of the size and shape of the tank. Therefore, the whistle alarm 18 will stop transmitting sound when the oil has reached the opening in the whistle, at 6 to 7 inches below the inside top of the tank. The volume of potentially undelivered oil (from top of oil to the top of the inside of the tank) will vary for different tank sizes. Seeing that the size of oil tanks is variable and the depth that the whistle alarm 18 protrudes into the tank is constant, the operator of the delivery truck will have to set the hand 20 on the dial 19 to the size of the tank and thereby increase or decrease the time delay required to provide for maximum filling of the tank above the opening in the whistle alarm 18. For example, a 250 gallon tank may require a 5-second delay; a thousand gallon tank, a 20-second delay etc.

In the operation of this invention, as shown in FIGS. 1, 2 and 3, the spout 10 on the end of the oil delivery apparatus 9 is inserted into the fill pipe 16. The spring loaded trigger controlling the oil shut-off valve 11 is depressed and held depressed by a mechanical stop. At the same time, the switch 11*a* is depressed to permit power to flow and complete a circuit from the power source 13 to the solenoid 12 and to the amplifier circuit 21 via the first time delay circuit *7a*. After the first time delay, the power is returned to the circuit and the microphone 14 senses the sound from the whistle 18 as it is transmitted through the vent pipe 17 and maintains the power to the solenoid 12 to hold the solenoid in the open or non-active position. When the sound from the whistle 18 stops, the microphone 14 picks up the absence of the whistle sound and the solenoid 12 is activated, after the second time delay *7b*, to release the mechanical stop holding the shut-off valve 11 to effect closing off of the valve and stop the flow of oil through the delivery hose 8 to the spout 10 and to the oil tank reservoir 15.

The first time delay unit *7a* is effective due to the time element caused by the time it takes the oil to flow from the delivery truck 5 through the hose 8 to reach the tank 15 before the sound of the whistle is picked up and power is maintained between the power source 13 and the solenoid 12 to hold the valve 11 open, and the second time delay unit *7b* is effective after the whistle stops and power is maintained to the solenoid 12 and is controlled by the setting of the dial 19 so that the valve 11 remains open to fill the void at the top of the tank according to the setting of the hand 10 on the dial 19.

Regardless of the size and capacity of the tank to be filled with fluid, the whistle 18 on the end of the vent pipe 17 is generally located at a fixed depth below the top of the tank. Thus, in larger capacity tanks there is a much larger void above the level of the fluid as it contacts the whistle 18 and stops the whistle sound emitted and thus, a greater loss of filling capacity. This loss is overcome when the operator sets the hand 20 on the dial 19 to the capacity of the tank to be filled. The setting of the hand 20 on the dial 19 controls the time delay before the solenoid 12 acts to close the fill valve 11, thus permitting the flow of fluid to continue to fill the void in the tank above the level of the whistle 18. In this manner, the reaction of the operator to close the valve is eliminated and a uniform and maximum filling of the tank is achieved.

The embodiments of the invention in which an exclusive property or privilege is claimed are defined as follows:

1. A fluid delivery apparatus for maximum filling of a tank from a supply vehicle, the tank having a vent pipe with a whistle device therein which ceases to whistle when the fluid in the tank reaches a preset level, the apparatus comprising:

a fluid feed pipe from said supply vehicle, a delivery spout on the end of said feed pipe for insertion into the tank, a trigger shut off valve on the end of said feed pipe, an operating means for closing said shut off valve, a microphone located on the end of said feed pipe connected to an amplifier means said amplifier means connected to said operating means and adapted to produce a signal representing the whistle from said tank and prevent said operating means from closing said shut off valve while said amplifier produces said signal, and a time delay means operatively coupled to said operating means so as to prevent said operating means from closing said shut off valve for a predetermined time after the signal from the amplifier means terminates.

2. The fluid delivery apparatus as set forth in claim 1 including a setting dial adapted to be set to indicate the capacity of the tank to be filled, the setting of the dial controlling said time delay means and thus the predetermined time before the operating means closes said shut off valve.

3. The fluid delivery apparatus as set forth in claim 1 including a battery power source located on the end of said feed pipe for said amplifier means and operating means.

4. The fluid handling apparatus as set forth in claim 1 including a further preset time delay to prevent said operating means from closing said shut off valve, when said shut off valve is first opened.

* * * * *